US008202379B1

(12) United States Patent
DeLong et al.

(10) Patent No.: US 8,202,379 B1
(45) Date of Patent: Jun. 19, 2012

(54) NATURAL FIBER WELDING

(75) Inventors: Hugh C. DeLong, Waldorf, MD (US); Paul C. Trulove, Annapolis, MD (US); Luke M. Haverhals, Annapolis, MD (US); William M. Reichert, Annapolis, MD (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 232 days.

(21) Appl. No.: 12/629,915

(22) Filed: Dec. 3, 2009

(51) Int. Cl.
*D02J 11/00* (2006.01)
*C09J 5/00* (2006.01)

(52) U.S. Cl. ..... 156/83; 156/296; 156/305

(58) Field of Classification Search ..... 156/296, 156/305, 83

See application file for complete search history.

(56) References Cited

U.S. PATENT DOCUMENTS

2008/0023162 A1* 1/2008 Myllymaki et al. ..... 162/163
2009/0022775 A1* 1/2009 Champ et al. ..... 424/423

FOREIGN PATENT DOCUMENTS

WO WO 2007/032022 * 3/2007
WO WO 2007/085624 * 8/2007

* cited by examiner

*Primary Examiner* — Katarzyna Wyrozebski Lee
*Assistant Examiner* — Scott W Dodds
(74) *Attorney, Agent, or Firm* — AFMCLO/JAZ; Bart Hersko

(57) ABSTRACT

Natural fiber welding is a process by which individual fibers are swollen by an appropriate ionic liquid-based solvent system to form a congealed network. Manipulated fibrous materials may be either composed of natural polymers such as cellulose, hemicellulose, silk, et cetera, or synthetic polymers, or mixed materials. The process is principally controlled by the composition of the solvent system which includes an ionic liquid solvent plus additives such as water, methanol, et cetera. Other conditions such as the amount and placement of solvent, as well as time, temperature, and pressure control the extent to which neighboring fibers are fused. Only the material at the outer surface of fibers need be sufficiently mobile to merge with that of neighboring fibers. Material in the fiber core may be left in the native state by controlling process variables. Fibers form a congealed network upon removal of the ionic liquid-based solvent.

10 Claims, 9 Drawing Sheets

NATURAL FIBER WELDING

RIGHTS OF THE GOVERNMENT

The invention described herein may be manufactured and used by or for the Government of the United States for all governmental purposes without the payment of any royalty.

BACKGROUND OF THE INVENTION

The invention relates to the partial dissolution of natural fibers for the purposes of structural and chemical modifications.

Synthetic polymers such as polystyrene are routinely welded using solvents such as dichloromethane. Natural fiber welding is a process by which biopolymer fibers are fused in a manner roughly analogous to traditional plastic welding. Prior to the discovery that ionic liquids (i.e., 1-ethyl-3-methylimidazolium acetate) can dissolve biopolymers (i.e., cellulose and silk) without derivatization, there were no analogous solvents for natural materials. In addition to the utilization of an ionic liquid, control over the presence and amount of molecular additives (i.e., water, methanol, et cetera) is essential to controlling solvent efficacy. The demonstration of process control by careful manipulation of molecular additives is a fundamental feature that sets this invention apart from previous work. (Previous disclosures and patents exclusively invoke the utilization of neat or "pure" ionic liquids and do not recognize the vital importance of molecular additive control.)

There are many examples in both literature and patents of biopolymer solutions that are cast into molds to create a desired shape. In all of these cases, the biopolymer is completely dissolved so that the original structure is fully disrupted. With fiber welding, the fiber interior is intentionally left in its native state. This is potentially advantageous because the final structure retains some of the original material properties and is significant for creating materials from biopolymers such as silk and cellulose.

Traditional methods of cast molding biopolymer solutions are also disadvantaged in that there is a physical limit to how much polymer can be dissolved in solution. Typically, solutions that are 10% by mass biopolymer (90% by mass ionic liquid solvent) are generally quite viscous and difficult to handle, even at elevated temperatures. The fiber welding process allows (dry) fiber bundles to be manipulated into the desired shape before welding commences. The use and handling of native fibers often grants control over the engineering of the final product that is not possible for solution based technologies.

SUMMARY OF THE INVENTION

The invention is a process by which individual natural fibers such as cellulose, chitin, chitosan, collagen, hemicellulose, lignin, silk, et cetera, are swollen by an appropriate ionic liquid-based solvent system, and then reconstituted to form a congealed network. A cartoon of the fiber welding process is shown in FIG. 1. During welding, fiber bundles are swelled and mobilized by an appropriate ionic liquid-based solvent system, for example, 1-ethyl-3-methylimidazolium (+) acetate (−), abbreviated [EMI] [Ac], with molecular additives (not shown). Note that only the polymer at the outer surface need be sufficiently mobile to merge with that of neighboring fibers; material in the fiber core may be left in its native state. The depth of solvent penetration and the degree to which fibers are welded together is controlled by the nature (composition) and amount of solvent, temperature, pressure, spacing of the fibers, et cetera. Solvent removal leaves welded fibers. In addition to polymer movement, chemical derivatization may also be undertaken during this process. In general, the process increases the material density and decreases the surface area of a bundle of fibers. The mobilized fiber sheath may be modified with materials such as clay, carbon nanotubes, iron oxide, titanium dioxide, et cetera, to affect electronic, spectroscopic, thermal conductivity, magnetism, and antibacterial properties. In addition to regiospecific alteration of the physical properties, spatial control of chemical properties is also possible. Chemical properties (e.g., hydrophobicity, reactivity) at the fiber surface may be either similar to, or significantly different from the core (native fiber) depending on choice of derivatization.

DETAILED DESCRIPTION

Figure 1:
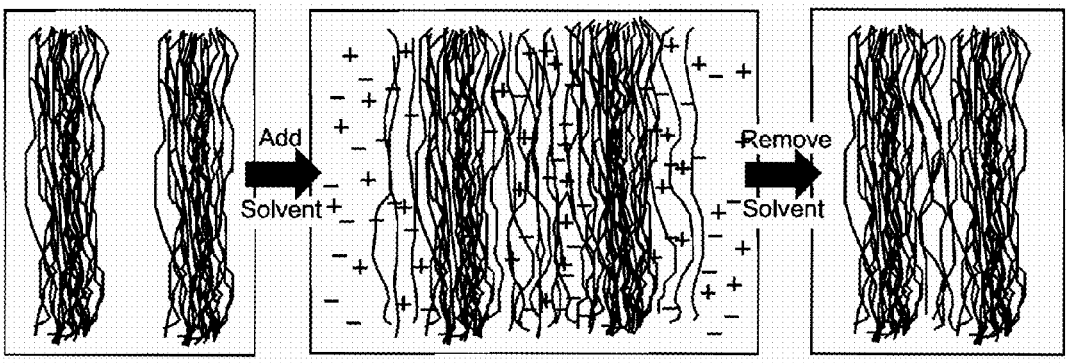
FIG. 1 is a carton of the fiber welding process.

Natural fiber welding is a processing technique by which natural fibers are swollen by an appropriate ionic liquid-based solvent system for the purpose of subsequent physical or chemical manipulation. The solvent system must be capable of interrupting intermolecular bonding (at least partially) to open and mobilize (solvate) the polymer for modification. Molecular additives such as water, methanol, et cetera are meticulously controlled to modify the solvent efficacy. Additionally, the amount of solvent (relative to polymer) is often intentionally kept low to limit the degree to which materials are modified. The ionic liquid-based solvent may be removed either by a second solvent system or by evaporation if the welding solvent is sufficiently volatile. (The evaporation rate may be increased significantly by placing the sample under vacuum.)

As used herein the term "ionic liquid" refers to a liquid that is comprised of anions and cations. Ionic liquids are attractive solvents as they are non-volatile, non-flammable, have a high thermal stability, are relatively inexpensive to manufacture, are environmentally friendly, and can be used to provide greater control and flexibility in the overall processing methodology. Ionic liquids of interest exist as liquids well below room temperature up to a temperature as high as 200° C. U.S.

patent application Ser. No. 11/326,678, filed on Dec. 29, 2005, and incorporated herein by reference, contains numerous examples of suitable ionic liquid solvents for use in the present invention. Preferably, the ionic liquid solvents have melting points below 150° C., more preferably, below about 100° C.

As used herein the term "ionic liquid-based solvent" refers to a liquid containing an ionic liquid mixed with at least one other molecular component. Molecular components can be solvents such as water, methanol, et cetera that can strongly interact with the cations and/or anions of the ionic liquid.

The method for natural fiber welding comprises partially dissolving either biopolymers or synthetic polymers with a molten ionic liquid-based solvent wherein said ionic liquid solvent component is comprised of cations and anions and has a melting point below 150° C. The ionic liquid-based solvents utilized contain molecular species that modify solvent efficacy (with respect to dissolution of polymers). Whereas previous work (patents) teach and detail the use of neat (pure) ionic liquids, the present disclosure details the utilization of systems that are ionic liquid(s) with at least one molecular component. The addition molecular components allow processing to be accomplished with much improved levels of control and are essential to the creation of advanced composite materials. Additionally, ionic liquids may be diluted by a molecular solvent (generally a non-solvent for the partially dissolved polymer materials) such that the partial dissolution process of the biopolymers or synthetic polymer materials commences upon removal of the diluent by heating or simple evaporation. The diluent may be a molecular solvent such as water, alcohols, or ketones (or mixture of these). The solvent system partially dissolves biopolymer or synthetic polymer materials to form a congealed network. Removal of the ionic liquid-based solvent is generally accomplished by combining the mixture with a large excess of non-solvent for the partially dissolved polymer materials that leeches the ionic liquid into a phase separate from the solidified materials. This washing method removes any excess ionic liquid-based solvents from the fiber surface as well as dialyzing away the solvent system from the congealed fiber network. Solvents used to remove the ionic liquid(s) from treated materials are generally similar to those previously mentioned as potential molecular diluents (i.e., water, methanol).

The fiber welding process facilitates the creation of functional structures from the controlled fusion of fibrous threads, woven materials, or fibrous mats. The physical and chemical properties of said materials are reproducibly manipulated by rigorous control of the amount of ionic liquid-based solvent applied, the duration of exposure to ionic liquid temperature, the temperature and pressure applied during the treatment. Materials may be joined to create laminate structures with proper control of process variables. The surface of these materials may be preferentially modified while leaving some of the material in the native state. Surface modifications my include manipulation of the material surface chemistry directly, or indirectly by the addition of particles to impart the desired physical or chemical properties.

Figure 2:
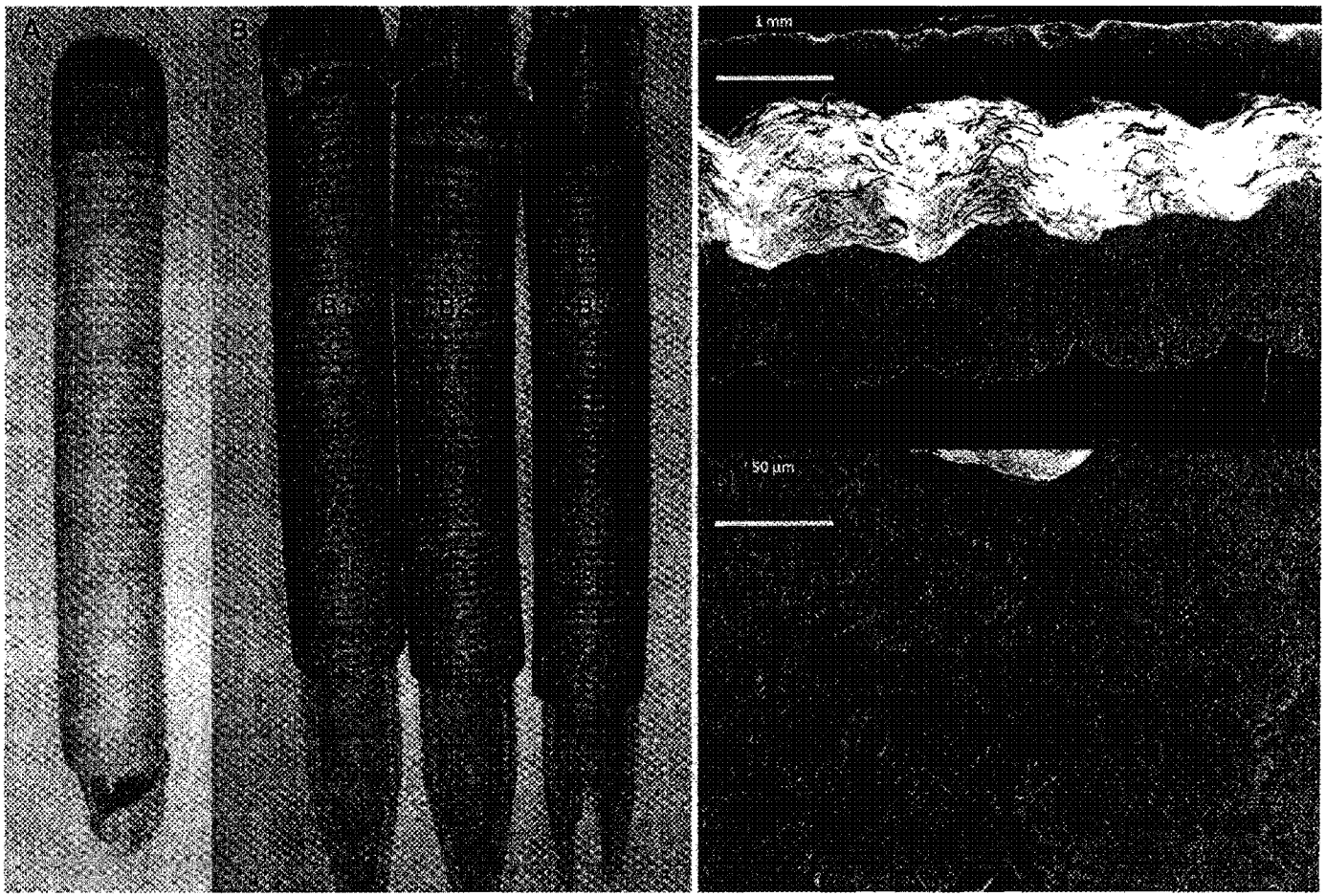
FIG. 2 shows images of cotton cylinders before and after fiber welding with an [EMI] [Ac]-based solvent system.

An example of the fiber welding process is detailed in FIG. 2 and includes images of cotton cylinders before (A), and after (B, C, and D) fiber welding with a solvent system containing 1-ethyl-3-methylimidazolium acetate ([EMI] [Ac] and water. Cotton thread (Wellington 3 lb Twisted Cotton Post Twine) was coiled around a test tube (A) and was soaked in a bath of the ionic liquid-based solvent for several minutes. Cotton coils were removed from bath, excess solvent was gently brushed away, and were placed in an oven at 60° C. for one, two, and three days, respectively. Coils were then immersed in double distilled water for about 12 hours upon removal from the oven (end of treatment). Water in the coagulation bath was replaced several times to fully remove the ionic liquid. Upon removal of the ionic liquid, the coils were placed in an oven at 80° C. While drying, the coils were observed to contract and densify to create solid cylinders. Image B shows three cylinders after processing. Cylinder B1 has been exposed to the solvent system for 1 day, cylinder B2 for 2 days, and cylinder B3 for 3 days. Note that the contraction of the cylinder length is greater for longer exposures. Dry cylinders were observed to be strong and stiff. Panels C and D show Scanning Electron Microscopy (SEM) images of the cross-section of several threads from one of the welded cylinders (cylinder B3). Image C shows that the outer portion of each thread has been fused to its neighbors. Image D shows that individual fibers that make up each thread are also welded together and contribute to the treated coil's enhanced rigidity.

1. Important Fiber Welding Variables

In addition to the choice of solvent and the type of material treated, three process variables principally determine the outcome of the welding process: time (of treatment), temperature (of treatment), and the concentration of solvent (ratio of solvent to treated material). The impact of each variable is described in the examples that follow.

1A. Treatment Time

Figure 3:
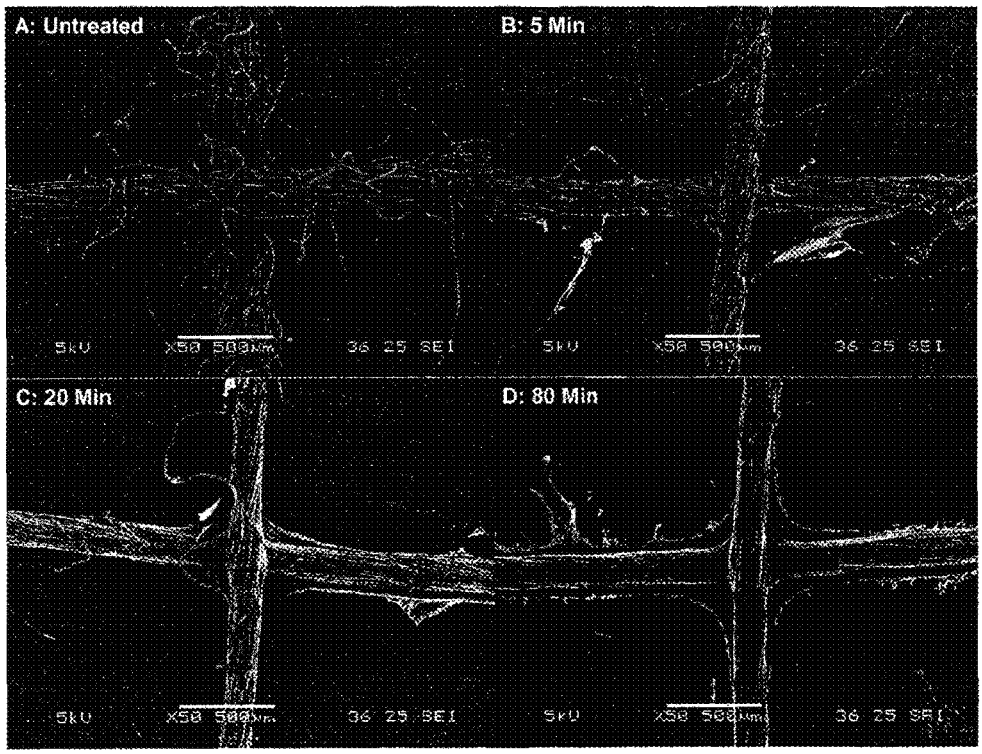
FIG. 3 shows SEM images of intersecting cotton thread at various treatment times.
Figure 4:
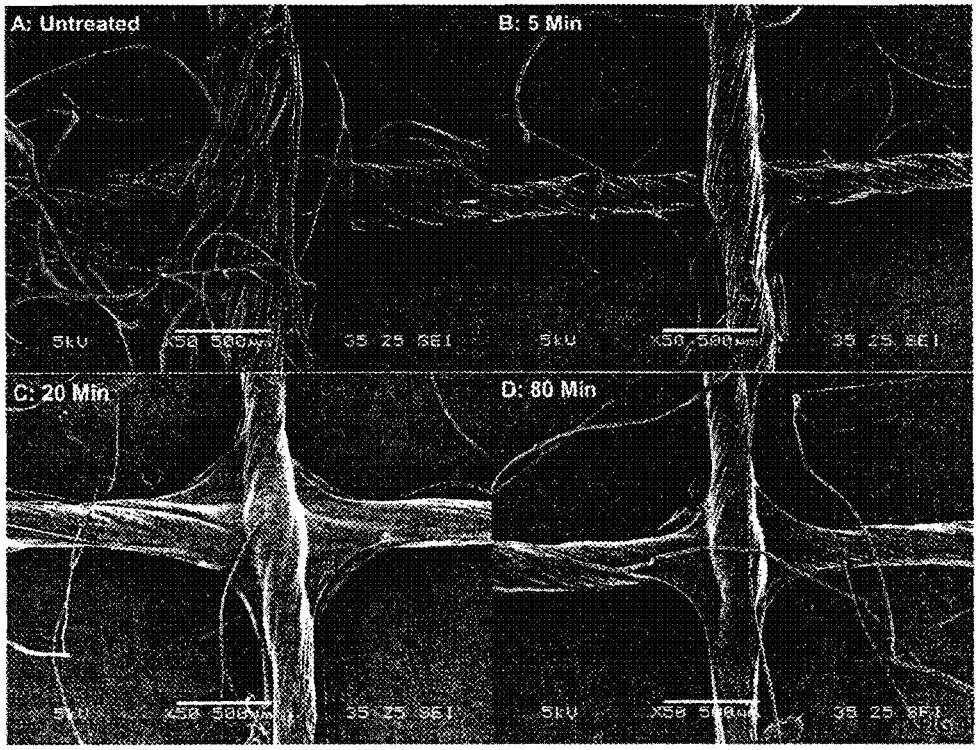
FIG. 4 shows SEM images of intersecting cotton thread at various treatment times.

FIG. 3 shows SEM images of the intersection of cotton threads (cellulose) welded together by exposure to an [EMI] [Ac]-based solvent system. Junctions were exposed to ~50 μL of [EMI] [Ac] after which the solvent is removed by immersion in water. Image A shows a native (untreated) cotton thread junction. Image B shows a similar junction after five minutes of treatment followed by a thorough rinse in water to remove the ionic liquid-based solvent. Images C and D show junctions after treatments of twenty and eighty minutes, respectively. As evident in the images, threads are progressively joined with increasing exposure time to the solvent system. FIG. 4 shows SEM images for a similar experiment with hemp fibers. (Hemp differs from cotton in the composition of cellulose, hemicelluloses, and lignin.) Panel A shows the native intersection while panels B, C, and D show junctions treated with ~50 μL of [EMI] [Ac] at 60° C. for five, twenty, and eighty minutes, respectively. As with cotton, hemp fibers fuse more completely as the exposure time to [EMI] [Ac] increases.

1B. Treatment Temperature

In addition to treatment time, temperature is also extremely important in determining the extent to which fibers are modified during the welding process. X-Ray Diffraction (XRD) (FIG. 5 and Table I), Fourier Transform Infrared Spectroscopy (FTIR) (FIG. 6), and tensile testing (Table II) data comparing welded cotton cloth aid to quantify the effect of temperature and time on the welding process.

The model system studied was Regency 22 count cotton cloth processed with 1.3 g [EMI] [Ac]-based solvent (with additional water and acetic acid to control solvent system efficacy) applied per $cm^2$ of cloth for five, ten, and thirty minutes at room temperature and 80° C., respectively. Note that the applied rate of ionic liquid is similar to the cotton cloth's density and that the cloth was stretched and pinned over a rigid polystyrene plate during processing to prevent significant contraction of treated samples. The ionic liquid-based solvent was removed by immersion in water. A small piece of cloth was also completely dissolved (in [EMI] [Ac]-based solvent) and then reconstituted in water for comparative purposes.

Figure 5:
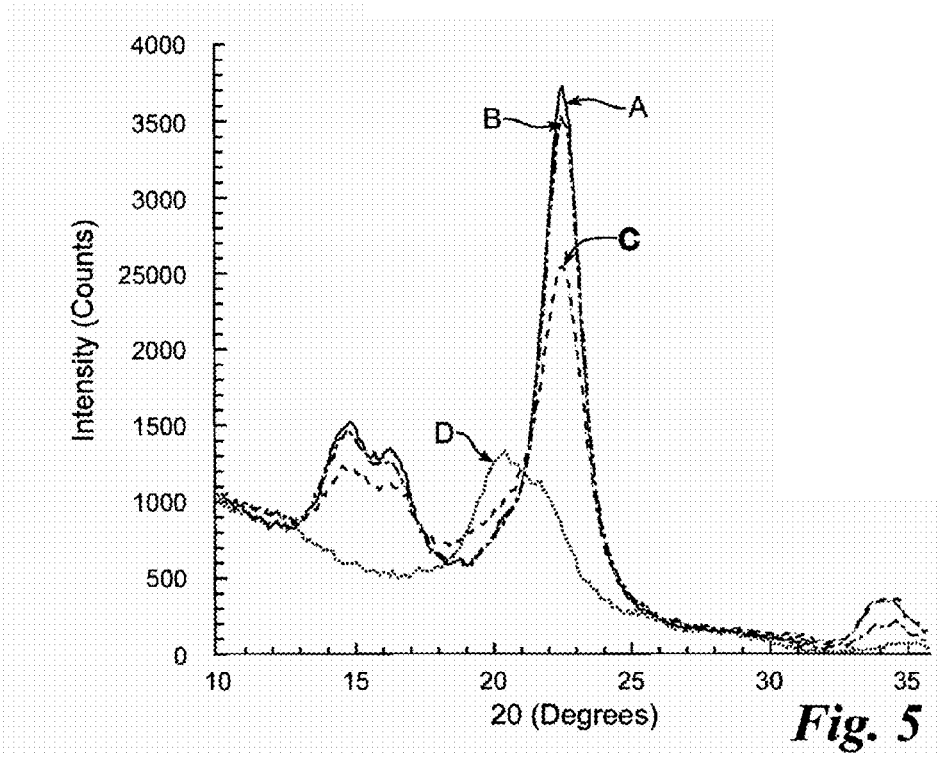
FIG. 5 is a plot of powder XRD data for native and treated cotton cloth.

Powder XRD data (FIG. 5 and Table I) show structural changes occurring with time and temperature of treatment. Plot designations in FIG. 5 are as follows: A=native cloth, B=welded 30 min at 20° C., C=welded 5 min at 80° C., D=cloth that was completely dissolved and then reconstituted. The pattern for native cotton (curve A) is typical for cellulose with a doublet at 2θ=15° and 16.5°, a sharp peak at 22.5°, and a broad peak at 34° attributable to cellulose 101, 101, 002, and 040 respectively. Fully dissolved and then reconstituted cotton (curve D) is typical of amorphous cellulose with the broad 021 reflection centered at 2θ=21°. Data for welded samples (curves B and C) show a clear trend of decreased crystallinity with increasing temperature and time of welding.

Data from curves B and C can be fit using linear combinations of curves A and D to deduce the approximate amount of native cotton converted to amorphous cellulose (Table I). Fits from additional experiments similar to those just described (but with different treatment times) are presented in Table I below. Results underpin the conclusion that native material structure is lost with increasing treatment temperature and time. The tunable nature of the fiber welding process is also apparent from these results.

TABLE I

| Sample Type | % Conversion (%) |
|---|---|
| Native Cotton Cloth | — |
| Cotton Cloth 5 Min at 20° C. | 2 |
| Cotton Cloth 10 Min at 20° C. | 4 |
| Cotton Cloth 30 Min at 20° C. | 6 |
| Cotton Cloth 5 Min at 80° C. | 40 |
| Cotton Cloth 10 Min at 80° C. | 44 |
| Cotton Cloth 30 Min at 80° C. | 48 |

Figure 6:
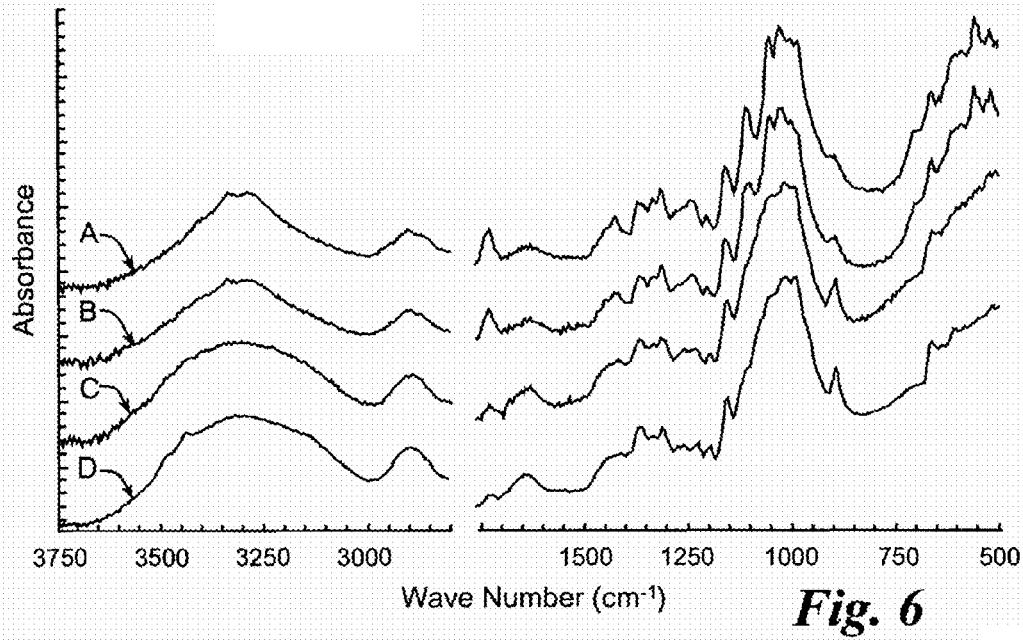
FIG. 6 is a plot of FTIR spectra data for native and treated cotton cloth.

FIG. 6 shows FTIR spectra for untreated (native) cotton cloth, and similar treated cotton cloth. Plot designations are as follows: A=native cloth, B=welded 30 min at 20° C., C=welded 5 min at 80° C., D=cloth that was completely dissolved and then reconstituted. The absorbance spectrum for native cotton cloth (curve A) is similar to that previously reported for cellulose, notably absorption due to O—H stretching vibrations are evident at 2600-3500 $cm^{-1}$ and C—C stretching and COH and CCH deformation vibrations at 1000-1300 $cm^{-1}$. Spectra for welded samples (curves B and C) are free of residual [EMI] [Ac] and show clear deviance from the native sample in these regions presumably due to changes in hydrogen bonding. Spectral changes are more dramatic for samples treated at 80° C. Although XRD data suggest approximately 60% of the cotton is left in the native state, the FT-IR spectrum for cotton treated for 5 minutes at 80° C. (curve C) is very similar to that of reconstituted cotton (curve D). Note that the ATR FT-IR analysis probes the outer surface of the cotton fibers while XRD is a bulk analysis technique. The likely explanation is that cellulose near the surface is preferentially "dissolved" and mobilized as the ionic liquid modifies the fibers.

The modification comes to bear in tensile testing results (Table II). Cloth samples with 20.0 mm gauge lengths and 5.0 mm wide were subjected to tensile testing in two distinct orientations with respect to the aida-type weave. Stress was applied either in line with the aida weave (parallel and perpendicular to individual threads) or stress was applied at 45° with respect to the weave (45° with respect to all individual threads). Tensile testing results are reported in Table II below. Errors are the standard deviations and "n" is the number of individual samples tested for each sample type. Data are normalized by the cross sectional breaking point area.

TABLE II

| Sample Type | n | % Elong. at Break (%) | Energy to Break ($J/cm^3$) | Max Stress at Break (Mpa) | Young's Modulus (Mpa) |
|---|---|---|---|---|---|
| Stress in line with the aida weave. | | | | | |
| Native Cotton Cloth | 8 | 17.7 +/− 1.2 | 2.3 +/− 0.1 | 28 +/− 1 | 45 +/− 9 |
| Cotton Cloth 5 Min at 20° C. | 8 | 14.8 +/− 0.9 | 2.2 +/− 0.1 | 30 +/− 1 | 69 +/− 10 |
| Cotton Cloth 10 Min at 20° C. | 8 | 15.4 +/− 0.7 | 2.1 +/− 0.1 | 28 +/− 1 | 49 +/− 6 |
| Cotton Cloth 30 Min at 20° C. | 8 | 14.8 +/− 0.7 | 2.1 +/− 0.1 | 30 +/− 1 | 75 +/− 10 |
| Cotton Cloth 5 Min at 80° C. | 8 | 13.6 +/− 0.3 | 2.5 +/− 0.1 | 29 +/− 1 | 540 +/− 10 |
| Cotton Cloth 10 Min at 80° C. | 8 | 11.7 +/− 0.4 | 2.3 +/− 0.1 | 28 +/− 1 | 620 +/− 20 |
| Cotton Cloth 30 Min at 80° C. | 8 | 11.0 +/− 0.7 | 2.4 +/− 0.2 | 31 +/− 1 | 750 +/− 30 |
| Stress 45° to the aida weave. | | | | | |
| Native Cotton Cloth | 8 | 25 +/− 2 | 0.06 +/− 0.01 | 0.40 +/− 0.03 | 2.1 +/− 0.1 |
| Cotton Cloth 5 Min at 20° C. | 4 | 30 +/− 2 | 0.10 +/− 0.02 | 0.59 +/− 0.05 | 2.8 +/− 0.5 |
| Cotton Cloth 10 Min at 20° C. | 4 | 29 +/− 2 | 0.11 +/− 0.01 | 0.62 +/− 0.02 | 3.6 +/− 0.1 |
| Cotton Cloth 30 Min at 20° C. | 4 | 26 +/− 1 | 0.09 +/− 0.01 | 0.59 +/− 0.02 | 3.3 +/− 0.3 |
| Cotton Cloth 5 Min at 80° C. | 3 | 21 +/− 2 | 2.2 +/− 0.1 | 12 +/− 1 | 470 +/− 20 |
| Cotton Cloth 10 Min at 80° C. | 3 | 19 +/− 3 | 2.5 +/− 0.5 | 15 +/− 1 | 580 +/− 60 |
| Cotton Cloth 30 Min at 80° C | 3 | 16 +/− 2 | 2.4 +/− 0.5 | 18 +/− 2 | 580 +/− 80 |

When stress is applied in line with the aida weave, the cloth modulus increases by more than an order of magnitude for samples welded at 80° C., however, energy to break and maximum stress at break were not significantly modified for treated samples. Results may be explained by noting that load bearing threads failed at locations between thread intersections. As already shown in FIGS. 3 and 4, increased treatment time increases the amalgamation between individual fibers and intersecting threads and thus increases the material stiffness (the modulus) because fibers that make up threads and the threads themselves are not free to slide past one another. The maximum stress and energy to break samples are not affected in this test because the direction of the force does not test the welded network. Instead, the load tests the aggregate strength of threads running parallel to the stress at their weakest point (i.e., between thread intersections). While fibers that make up threads are fused, the amount and strength of that material do not appear to be changed and thus there are no observed changes in either the maximum stress or energy to break.

When stress is applied at 45° with respect to the aida weave, results are significantly different for the modulus, maximum stress, and energy to break of treated versus untreated samples. The strength and toughness of samples treated at 80° C. are vastly superior to that of the other samples and can be rationalized by noting that this mode of testing probes the degree to which intersecting threads are fused. Due to the size of samples tested and the type of weave, threads did not run the entire gauge length of the sample. Untreated samples were therefore extremely weak because threads could easily slip past one another causing the structure to fail at low stress. Samples treated at 20° C. show roughly a two-fold improvement, but thread intersections still do not appear to be strongly fused. Samples treated at 80° C. show robust fusion between intersecting threads. The material strength is improved more than 200-fold over native samples. The strength of the welded intersections even approached that of samples in which the applied load was in line with the aida weave.

1C. Treatment Concentration

In previous examples, materials were treated with [EMI] [Ac] plus several parts per thousand (by mass) water, respectively. Solvent loadings (the ratio of the mass of [EMI] [Ac] to the mass of the material treated) were intentionally kept low to control the amount of welding. The amount of [EMI] [Ac]-based solvent applied to aida-type cotton cloth, for example, was not sufficient to completely dissolve the total amount of polymer present (even if the treatment time was much longer). However, it is often not possible to weld fibrous materials with neat [EMI] [Ac] due to limitations of viscosity and the strong dissolution properties of [EMI] [Ac]. For example, cotton balls are essentially a loose, random network of fine cellulose fibers. The viscosity of [EMI] [Ac] makes it difficult to realize a consistent solvent loading when treating this type of material. In addition, many fine fibers quickly dissolve (completely) even at room temperature when exposed to neat [EMI] [Ac]. (These problems also occur when working with loose silk.)

There are two ways to weld materials composed of fine fibers. One solution is to use an (unique) ionic liquid solvent that is a less capable of solubilizing the material of interest. This is generally an undesirable strategy because each unique material requires the development of a distinct ionic liquid solvent optimized for the desired amount of treatment. A more efficient strategy is to dilute a strong solvent such as [EMI] [Ac] with a molecular component such as methanol that strongly interacts with the ionic liquid. The dilution has two essential purposes. First, the dilution modifies solvent efficacy and prevents the ionic liquid from dissolving the material until the prescribed time (after the volatile solvent is removed). Second, the dilution allows precise control of the amount of ionic liquid introduced. For example, dilute [EMI] [Ac] in methanol solutions can be introduced to cotton balls with minimal perturbation to the native material structure. This is possible because methanol decreases the solution viscosity and lowers the solvating capabilities of [EMI] [Ac]. Methanol is then driven off with heat or by vacuum at a later time to commence the welding process.

Figure 7:
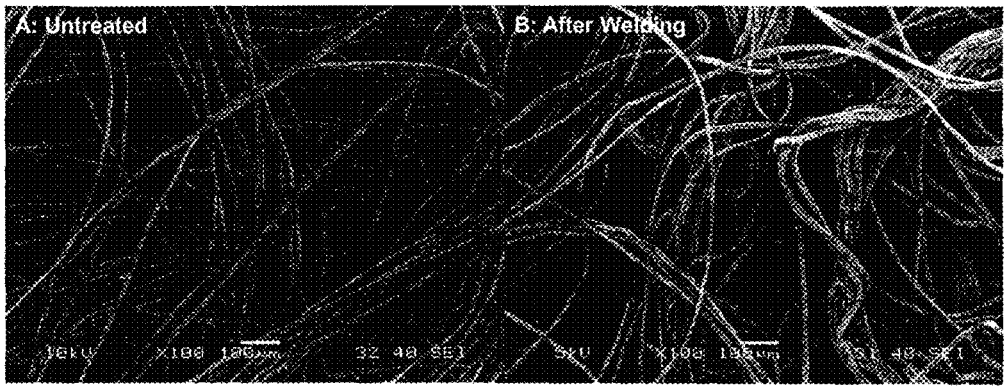
FIG. 7 shows SEM images of untreated and treated silk fibers.
Figure 8:
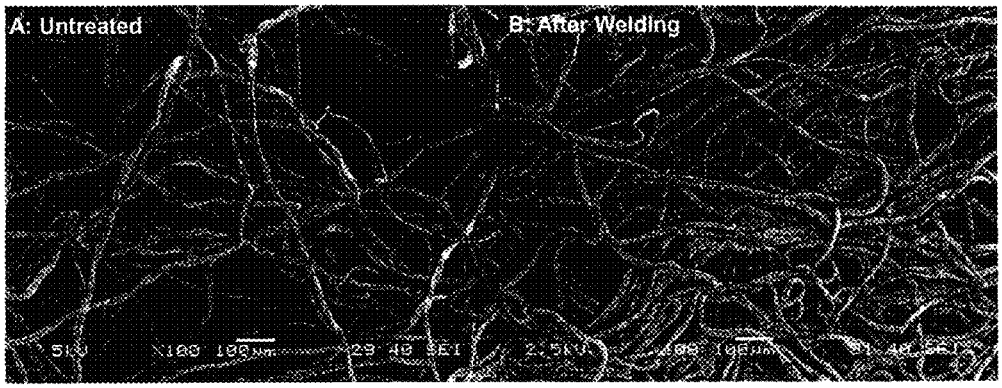
FIG. 8 shows SEM images of untreated and treated cotton fibers.

FIGS. 7 and 8 are SEM images of native and treated silk and cotton, respectively. The use of diluted [EMI] [Ac] (with methanol) is essential to control the degree of welding that is observed in the loose fiber networks. In both examples, one part (by volume) [EMI] [Ac] was mixed with nine parts methanol. Each of the two types of fibers were dipped in the solution (for several seconds) and placed in an oven at 60° C. Methanol was driven off as the samples were heated leaving a controlled amount [EMI] [Ac] (with trace water) evenly coated on individual fibers. Samples were left in the oven for several hours to remove the methanol and allow the remaining [EMI] [Ac]-based solvent sufficient time to act. Upon removal from the oven, samples were placed in double distilled water (to remove the ionic liquid) and then dried at 80° C. Images of treated samples show fused fibers (at intersections) not present in untreated blank samples.

2. Various Examples of Fiber Welding

Several examples follow that are embodiments of the invention where [EMI] [Ac] acts upon polymers such as cellulose and silk. The examples shown are not inclusive of all possible embodiments, but begin to map parameters of and possibilities for this invention.

Figure 9:
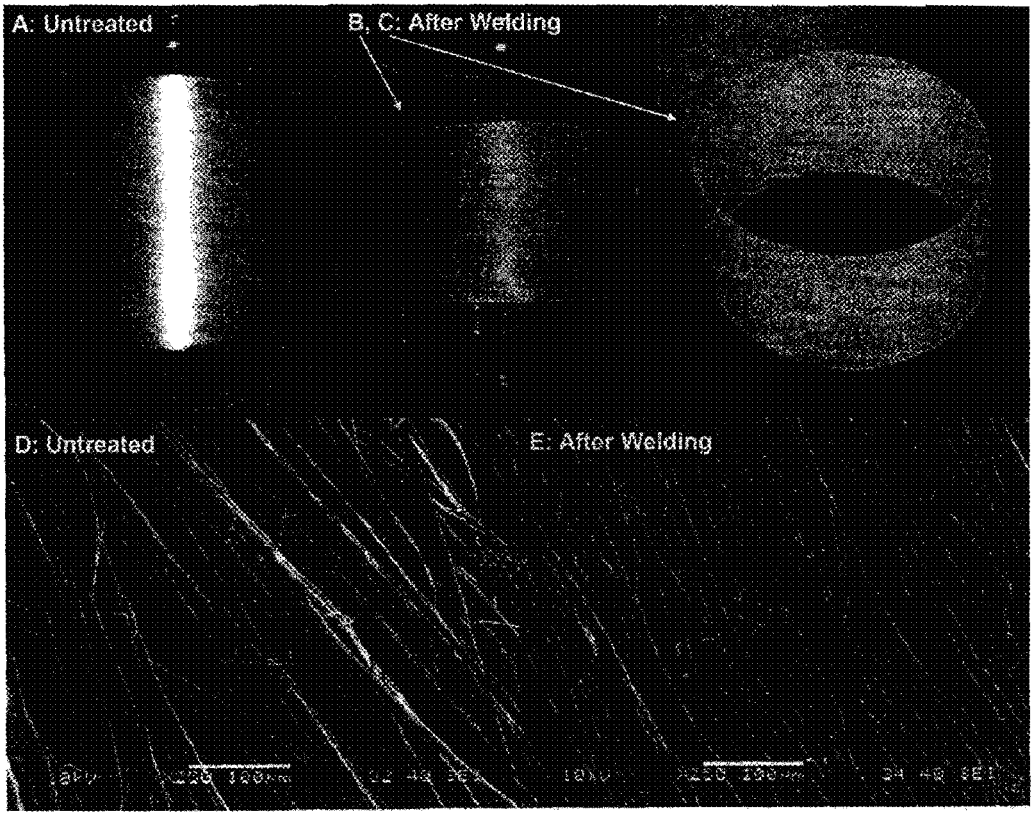
FIG. 9 shows images of silk before and after fiber welding with an [EMI] [Ac]-based solvent system.
Figure 10:
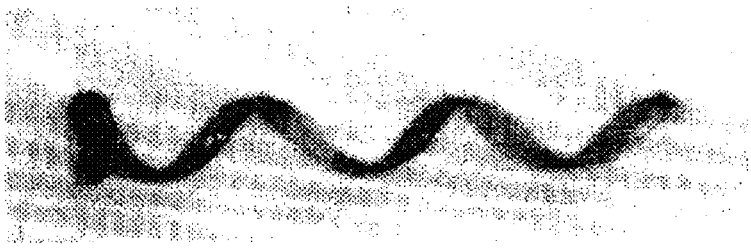
FIG. 10 shows a spring made of hemp.
Figure 11:
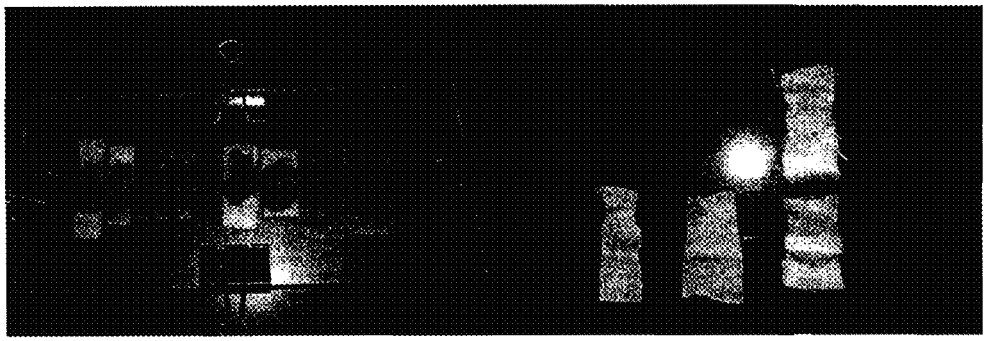
FIG. 11 shows examples of "glueless sewing".

FIG. 9 shows an application of fiber welding analogous to that shown in FIG. 2, but with silk instead of cotton. Silk (desized) is treated with [EMI] [Ac] for 24 hours at 60° C. The ionic liquid is then removed by immersing the sample in methanol. The result is a solid silk band that is observed to be strong and flexible. FIG. 10 shows a spring created from hemp thread. (Hemp is similar to that imaged in FIG. 5.) The hemp spring was processed in a similar manner to that just described (for the silk band). The result of this example is a strong yet flexible spring. FIG. 11 shows cotton, flax, and silk fabrics that have been welded together such that no glue is required. Welded joints can be made with just a few seconds of processing, particularly if heat and pressure are applied to a seam treated with neat [EMI] [Ac].

Figure 12:
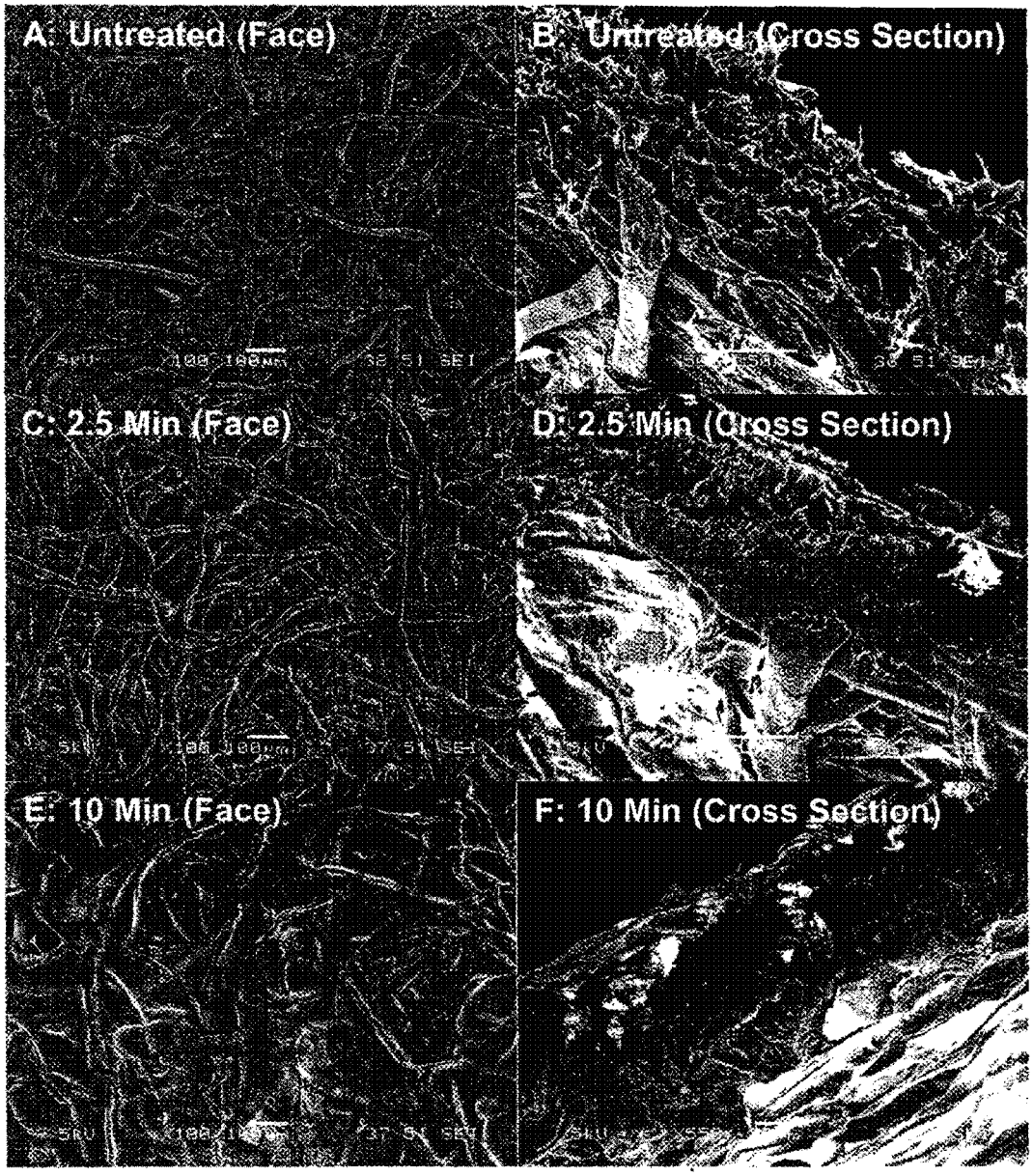
FIG. 12 shows SEM images of filter paper treated to manipulate the pore size.

FIG. 12 is a series of SEM images which demonstrate the manipulation of pore size of a standard filter paper. Fisher Scientific P8 filter paper (coarse porosity) is exposed to [EMI] [AC] at room temperature for varying times. The ionic liquid is removed by immersion in water followed by drying under vacuum. Pore size is observed to decrease with increasing treatment time.

3. Derivatization

In addition to consolidating individual fibers together, the fiber welding process permits the incorporation of a different material to the outside of natural fibers without significant change to the fiber interior. For example, nanoparticles such as carbon nanotubes or clays may be welded to the fiber surface, FIG. 13.

Figure 13:
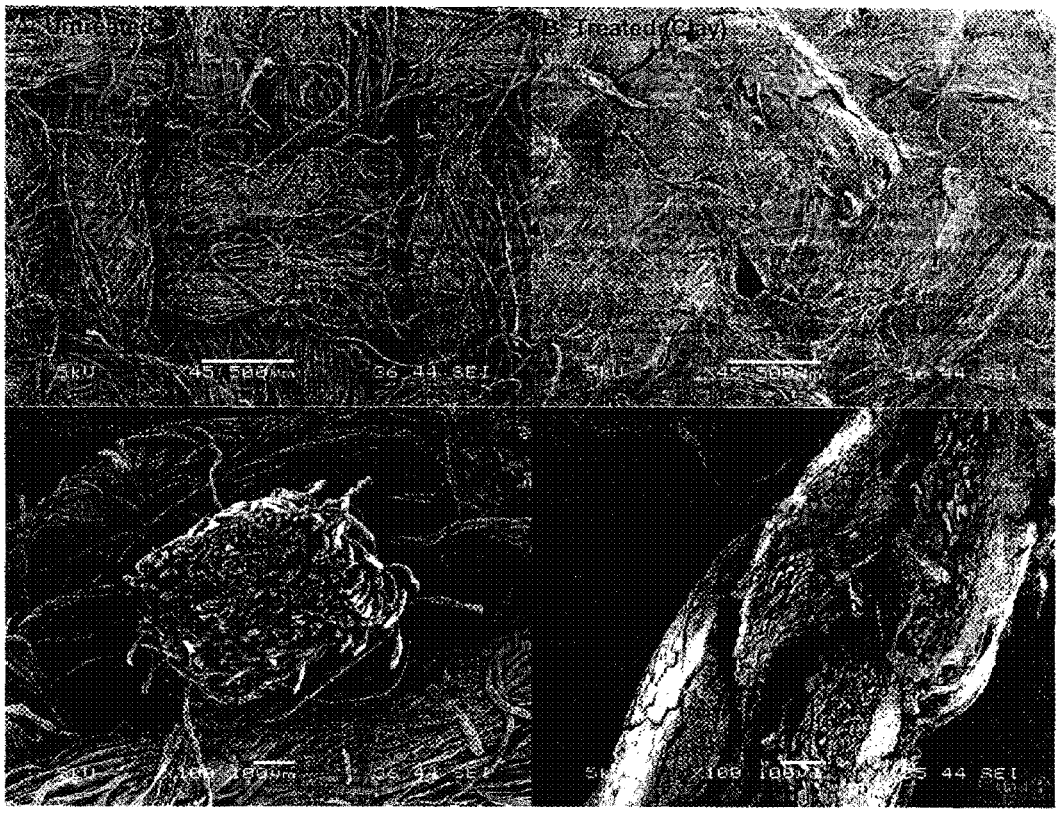
FIG. 13 shows SEM images of cotton cloth modified with a surface coat of clay.

The treated material shown in FIG. 13 was created by smearing a thin layer of a viscous paste of 3 g Cloisite 30B (Southern Clay) and 0.5 g 20 μm microcrystalline cellulose (Aldrich) in 4.5 g [EMI] [Ac] onto Regency 22 count cotton cloth. The slurry was allowed to remain on the cloth for 24 hours at room temperature before the [EMI] [Ac] was removed by a methanol rinse. Upon drying under vacuum, the treated cloth displayed good flexibility and the outer clay containing layer remained adequately adhered during flexing. SEM images show the surface of treated samples is modified with clay. We speculate that the clay surface treatment may be yield materials with superior resistance to combustion and flame spread. Combustion and flame spread testing will be conducted and submitted as addendums to this disclosure.

Chemical derivatization is an important aspect of fiber welding that remains to be demonstrated. There is a good deal of literature pertaining to functionalizing cellulose to control hydrophilicity, biocompatibility, et cetera. These chemistries are typically attempted in (homogeneous) systems where cellulose is thoroughly dispersed and solubilzed. It is thought that the swelling and mobilization stage of the fiber welding process may allow, for example, a fiber to be modified with a hydrophobic sheath while maintaining the native, structurally integrous core.

What is claimed is:

1. A method for joining fibrous material comprising partially dissolving either fibrous biopolymer or fibrous synthetic polymer materials with a molten ionic liquid-based solvent wherein said ionic liquid-based solvent contains an ionic liquid comprised of cations and anions in the liquid state and at least one molecular additive to improve the solvent efficacy, wherein said molecular additive is a molecular solvent, wherein said ionic liquid-based solvents are diluted by said molecular solvent and wherein the partial dissolution process of the biopolymers or synthetic polymer materials commences upon removal of the molecular solvent by heating or simple evaporation, or exposure to vacuum.

2. A method according to claim 1 wherein the molecular solvent is an alcohol.

3. A method according to claim 2 wherein said alcohol is methanol.

4. A method according to claim 1 wherein the biopolymers or synthetic polymer materials are fibrous threads, and wherein the fibrous threads are controllably fused to create functional structures.

5. A method according to claim 1 wherein the biopolymers or synthetic polymer materials are woven materials and wherein the physical properties of the woven materials are manipulated and controlled.

6. A method according to claim 5 wherein said woven materials are cast into functional structures.

7. A method according to claim 5 where the woven materials are joined to make laminate materials.

8. A method according to claim 1 wherein the biopolymers or synthetic polymer materials are fibrous mats and wherein the physical properties of the fibrous mats are manipulated and controlled.

9. A method according to claim 8 where fibrous mats are cast into functional structures.

10. A method according to claim 8 wherein the fibrous mats are joined to make laminate materials.

* * * * *